United States Patent [19]

Wallin

[11] Patent Number: 4,774,798

[45] Date of Patent: Oct. 4, 1988

[54] METHOD AND APPARATUS FOR ERECTING, FILLING AND SEALING A PACKING BLANK

[75] Inventor: Kay Wallin, Halmstad, Sweden

[73] Assignee: Sprinter System AB, Sweden

[21] Appl. No.: 15,134

[22] PCT Filed: May 30, 1986

[86] PCT No.: PCT/SE86/00253

§ 371 Date: Jan. 29, 1987

§ 102(e) Date: Jan. 29, 1987

[87] PCT Pub. No.: WO86/07031

PCT Pub. Date: Dec. 4, 1986

[30] Foreign Application Priority Data

May 30, 1985 [SE] Sweden ..... 8502677

[51] Int. Cl.[4] ..... B65B 11/08

[52] U.S. Cl. ..... 53/462; 53/456; 53/209

[58] Field of Search ..... 53/462, 456, 207, 209, 53/579, 534

[56] References Cited

U.S. PATENT DOCUMENTS

| | | | |
|---|---|---|---|
| 3,323,275 | 6/1967 | Kingsbury | 53/462 |
| 3,563,000 | 2/1971 | Whitehouse | 53/579 |
| 4,569,182 | 2/1986 | Leuvering | 53/462 X |

FOREIGN PATENT DOCUMENTS

| | | | |
|---|---|---|---|
| 2063811 | 6/1981 | United Kingdom | 53/579 |

*Primary Examiner*—John Sipos

*Attorney, Agent, or Firm*—Ostrolenk, Faber, Gerb & Soffen

[57] ABSTRACT

The invention relates to a method and apparatus for packing products (2) coming from a product line using packing blanks in a packing machine including at least one conveyor for advancing the blanks (1) through the machine, as well as erecting means for erecting the blanks around the products during conveyance through the machine. In accordance with the invention, the blanks are advanced upstanding from a magazine in the machine with the lid directed upwards, simultaneously as products (2) are advanced with the same direction, speed, spacing and number as the advanced blanks.

1 Claim, 3 Drawing Sheets

METHOD AND APPARATUS FOR ERECTING, FILLING AND SEALING A PACKING BLANK

The present invention relates to a method and an apparatus for packing products coming from a product line with packing blanks in a packing machine including at least one conveyor for advancing the blanks through the machine as well as erecting means for erecting the blanks around the products during conveyance through the machine, and a packing blank for use in carrying out the method.

There are no carriers or flights used in the method and apparatus in accordance with the invention for erecting the packing blank around the product, such flights otherwise being usual in similar machines. Conveyance of the blank through the machine is performed by a combined belt and vacuum conveyor right up to pressing down the lid flaps, after which the remaining flaps on the lid are folded down and sealed in a turning apparatus known per se. Since flights are not used, the machine has very short times for setting to different blank sizes, and there does not need to be any specific space between packing blanks or products, which means that unnecessary space between them is eliminated. The machine will thus be very effective. There is no need for synchronizing means between the products and the blanks, the products being sensed as to their position and thus they determine, with the aid of impulses sent to the magazine discharge, when the blank is to be taken from the magazine. In packing machines using flights, the flights can crush the packings in the machine when there is congestion, resulting in waste. This not the case with the inventive machine, which has a further advantage in that it is not restricted to a specific format. For example, when conveying fish sticks, or products of this type which cannot be conveyed on an ordinary conveyor, an overhead flight may be used for bringing the products to the packing blank. A further alternative with these flights is a means which moves down just before filling and stops the products simultaneously as they are aligned to have proper, mutual, relative positions so that they can be advanced to the packing blank uniformly.

The object of the present invention is thus to eliminate the disadvantages to be found in packing machines including flight means. The distinguishing features characterizing for the invention are disclosed in the following claims.

Figure 1:
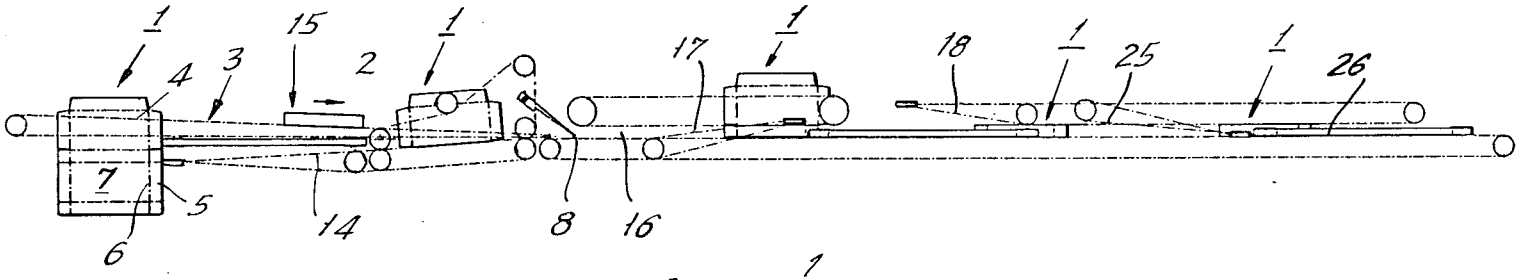

The invention will now be described in detail with reference to the accompanying drawing, on which FIG. 1 schematically illustrates how a product from a product line is packed with the aid of a machine in accordance with the present invention while using a packing blank formed in accordance with the invention, and FIGS. 1A–1H illustrate a top view of the packing blanks at various locations throughout the apparatus of the invention.

Figure 2:
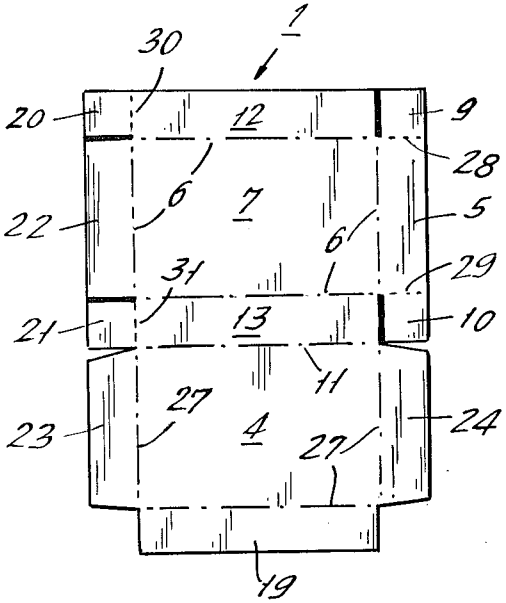

FIG. 2 is a plan of the packing blank used for carrying out the method in accordance with the invention.

Figure 1A:
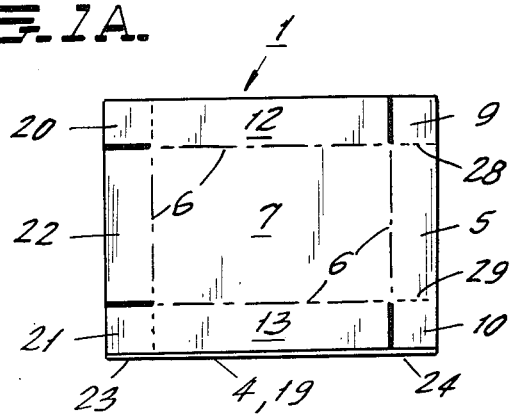
Figure 1B:
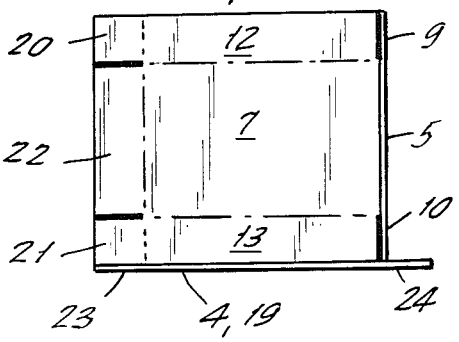
Figure 1C:
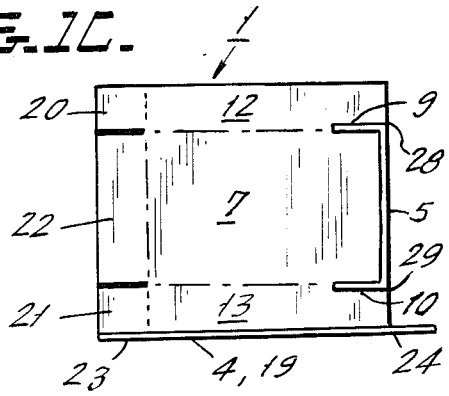
Figure 1D:
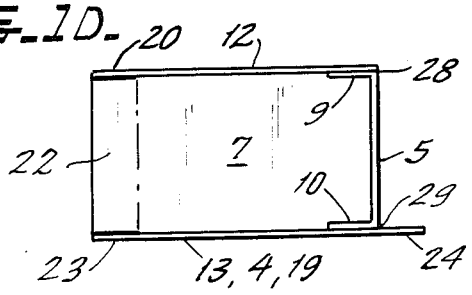
Figure 1E:
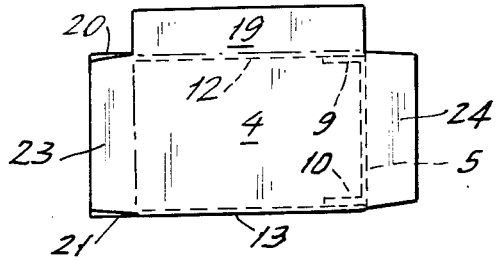
Figure 1F:
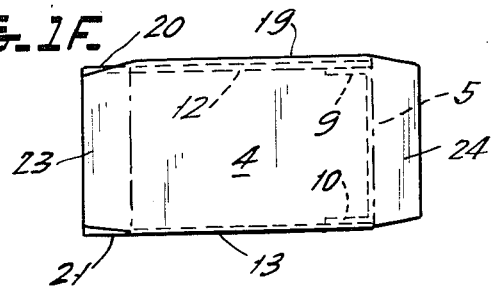
Figure 1G:
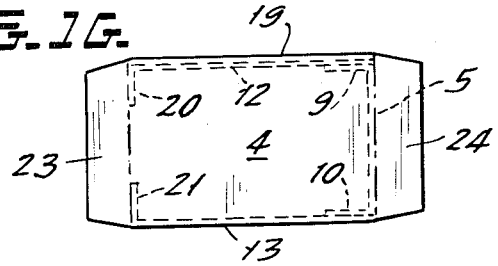
Figure 1H:
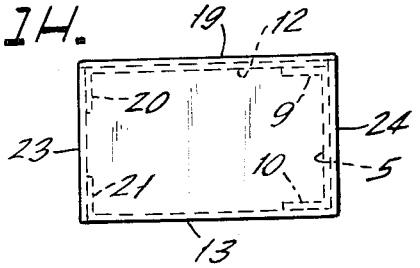

As will be seen from the drawing, packing products takes place in the following manner. The packing blanks 1 are taken from an unillustrated magazine or from a roll in a prestamped state, and are fed upstanding on a belt conveyor 3 with their lids 4 facing upwards. Products 2 are simultaneously advanced on a product line 15 with the same direction, speed, spacing and number as the advanced blanks 1. During the advance of the blank 1 on the belt conveyor 3, a forward end wall flap 5 is folded preliminary on the bottom or tray part of the blank 1 to take away the bias in a crease line 6 joining the end wall flap 5 with the bottom 7 of the blank 1. This is done with the aid of an unillustrated means including belts and a fixed folding plate with a protuberance for stopping, and an abutment for the forward edge of the blank 1. After a short interval the flap 5 is released once again, the desired prefold having been achieved. The bottom 7 of the blank 1 is then raised up to about 90° along a lid crease line 11 with the aid of a folding device 14 as seen in FIG. 1A. Shortly after this the product line 15 and blank line 3 meet and the end wall flap 5 is erected with the aid of a hook device 8, which is swivelable and folds the end wall flap upwards to about 90°, simultaneously as a product is advanced over the blank and released over its bottom 7. The blank at this stage of manufacture is shown in FIG. 1B. The product 2 is suitably advanced on the bottom 7 when the end wall flap 5 is retained with the aid of the hook device 8 pivotable up and down about a pin. When the product 2 is lying on the bottom 7 and the end wall flap 5 has been erected to 90°, the hook device 8 releases the blank edge. Folding devices 16 fold in side flaps 9, 10 on the end wall flap 5 inwards about 90° so that these lie parallel to each other, as seen in FIG. 1C. The long sides 12, 13 of the blank 1 are then folded by a plough-action folding device 17, simultaneously as the lid 4 and long side 13 are caused to lie in the same plane by folding along the lid crease line 11. The blank at this stage of manufacture is shown in FIG. 1D. The lid 4 is then folded down over the tray thus formed with the aid of a plough-action folding device 18 along the crease line 11, thus enclosing the product 2, as seen in FIG. 1E. The longitudinal side flap 19 of the lid 4 is folded down with a plough-action folding device 25 and is sealed against the exterior of the long side 12 with the aid of glue, hot air or microwave sealing, after which pressing the lid flap 19 down takes place with the aid of a pressing device 26. The blank at this stage of manufacture is shown in FIG. 1F. The package is then taken into a turning station, unillustrated on the drawing, where the blank is turned simultaneously as the flaps 20 and 21 of the respective long sides 12 and 13 are folded inwardly about 90° as shown in FIG. 1G. The flap 20 is folded in, e.g. with a fixed plough-action folding rail, and the other flap 21 is folded in with the aid of such as a movable arm. The rear end wall flap 22 of the packing is then folded up and fixed against the flaps 20 and 21. The finished folded blank is shown in FIG. 1H. The package is then ready for conveyance to such a larger collective packaging station for further transport to the customer.

The packing machine in accordance with the invention includes at least one conveyor for advancing the blanks 1 through the machine, and erecting means for erecting the blank 1 around a product 2 coming from a product line 15 while being conveyed through the machine. By the combination of belts and vacuum conveyors, no flights or compartments for the blanks are used in conveyance through the machine. Feeding the blanks 1 to the machine from such as a magazine takes place first of all with the aid of belts in a belt conveyor which advances the blanks 1 to a hook device 8, which folds up the forward end wall flap 5 of the blank about 90°, simultaneously as the product line 15 releases a product 2 on the bottom 7 of the blank 1. Before the blank 1 reaches the hook device 8, its bottom 7 is folded up to a horizontal position with the aid of a folding device 14. After the hook device 8, the blank conveyor comprises a combined belt and vacuum conveyor, there being a lid pressing device 26 situated above the conveyor at the termination thereof. After the folding device 16 there is a plough-action folding device 17 for folding up the side walls 12, 13. Next following is a plough-action folding device 18 for folding down the lid, and after this there is an application of glue before folding down the lid flap 19 with the aid of the plough-action folding device 25. A turning means not illustrated on the drawing, and known per se, is arranged in the machine after the pressing device 26 for the lid flap 19. The final downward folding of the lid flaps 23, 24 of the lid takes place in the turning means.

The packing blank in accordance with the present invention, used for carrying out the method, consists of an undivided piece of material, forming a bottom or tray part and a lid part after erection. Accordingly, the blank includes a bottom 7 with four side walls 5, 12, 13, 22, which may be folded up along bottom crease lines 6. A lid 4 is hingeable along the free end edge of a side wall with the aid of a crease line 11. The lid 4 includes three lid flaps 19, 23, 24, which are foldable along crease lines 27 for sealing the lid when the blank is erected. The forward end wall flap 5 of the blank 1 includes two extensions in the form of side flaps 9, 10 which are connected to the end wall flap 5 along crease lines 28, 29. The side flaps 9, 10 preferably have an extension from the crease lines 28, 29 corresponding to that of the side walls 12, 13 from the bottom crease lines 6. During the erection of the blank 1 the side walls 9, 10 are intended to retain the side walls 12, 13 in an erected state. In turn, the long sides 12, 13 have extensions in the area of the other end wall flap 22, which may be folded inwards 90° via crease lines 30, 31 when the blank is erected, these extensions being arranged to retain the end wall flap 22 in an erected state.

I claim:

1. A method for packing products in packing blanks, each of said blanks having a bottom, a front end wall flap, a first set of flaps disposed at opposite ends of said front end wall flap, two sides connected to said bottom and having front and rear ends, a lid, a side flap of said lid, and a second set of flaps disposed at the rear ends of said two sides, said method comprising:

advancing said blanks in a planar standing position on a first conveyor, while simultaneously advancing said products on a second conveyor to a location where said blanks and said products meet;

prefolding said front end wall flap of said blank to break a first crease;

folding said bottom of said blank upwards at an angle of approximately 90° with respect to said standing position along a second crease;

erecting said front end wall flap upwards to a position at an angle of approximately 90° with respect to said bottom of said blank, while simultaneously placing said product on said bottom of said blank;

folding said first set of flaps disposed at opposite ends of said front end wall flap inward at an angle of approximately 90° with respect to said front end wall flap;

folding said two sides of said blank upwards at an angle of approximately 90° with respect to said bottom and into contact with said first set of flaps, and folding downward said lid of said blank at an angle of approximately 90° with respect to said two sides;

folding said side flap of said lid downward at an angle of approximately 90° with respect to said lid and sealing said side flap to one of said sides of said blank;

turning said blank to fold inward said second set of flaps disposed at the rear ends of said two sides of said blank, said second set of flaps being then disposed at an angle of approximately 90° with respect to said two sides of said blank; and folding said rear end wall flap upwards at an angle of approximately 90° with respect to said bottom and into contact with said second set of flaps.

* * * * *